US005794318A

United States Patent [19]

Parker et al.

[11] Patent Number: 5,794,318

[45] Date of Patent: Aug. 18, 1998

[54] COMBINATION LAWN/GARDEN ORNAMENT AND CREMATION CONTAINER

[75] Inventors: Daniel J. Parker, Connersville, Ind.; Mark H. Thesken, Cincinnati, Ohio

[73] Assignee: Batesville Casket Company, Inc., Batesville, Ind.

[21] Appl. No.: 798,438

[22] Filed: Feb. 10, 1997

[51] Int. Cl.[6] ..... A61G 17/08

[52] U.S. Cl. ..... 27/1; 40/406

[58] Field of Search ..... 27/1, 2; 40/406, 40/407, 409; 239/16, 17; 428/13

[56] References Cited

U.S. PATENT DOCUMENTS

| | | | |
|---|---|---|---|
| D. 85,087 | 9/1931 | Clark . | |
| D. 87,176 | 6/1932 | Treiber . | |
| D. 169,347 | 4/1953 | Woodward . | |
| D. 201,132 | 5/1965 | Lawrence . | |
| D. 268,374 | 3/1983 | Dercks et al. . | |
| D. 344,839 | 3/1994 | May et al. . | |
| D. 345,848 | 4/1994 | May et al. . | |
| D. 356,421 | 3/1995 | Parker . | |
| D. 356,422 | 3/1995 | Parker . | |
| D. 360,732 | 7/1995 | Parker . | |
| D. 370,766 | 6/1996 | Parker . | |
| D. 370,767 | 6/1996 | Parker . | |
| D. 370,768 | 6/1996 | Parker . | |
| 1,940,771 | 12/1933 | Prier . | |
| 2,075,859 | 4/1937 | Martin . | |
| 2,777,233 | 1/1957 | Brandhorst . | |
| 4,324,026 | 4/1982 | Craft . | |
| 4,332,101 | 6/1982 | Tomita | 40/406 X |
| 4,648,162 | 3/1987 | Daino . | |
| 4,977,652 | 12/1990 | Graham . | |
| 5,029,373 | 7/1991 | Raymond . | |
| 5,208,957 | 5/1993 | Hereford . | |
| 5,230,127 | 7/1993 | Zukowski et al. . | |
| 5,234,728 | 8/1993 | Chiang | 40/406 X |
| 5,287,603 | 2/1994 | Schorman . | |
| 5,367,805 | 11/1994 | Bates | 40/406 |

OTHER PUBLICATIONS

Woodstock Chimes, Instruments of Nature, 20 pages, ©1996.

Woodstock Chimes, Instruments of Nature, 6 pages ©1995.

Woodstock Chimes, Presenting six new ways to go around the world of music, 6 pages, ©1997.

Virginia Metalcrafters, 10 pages, ©1994.

Planter Box, grey, two leaves, 1 page, undated.

Planter Box, brown, two leaves, 1 page, undated.

Wall Fountain, 1 page, undated.

Virginia Metalcrafters, Latticework Wall Fountain, 1 page, Spring, 1996.

*Primary Examiner*—Kien T. Nguyen

*Attorney, Agent, or Firm*—Wood, Herron & Evans

[57] ABSTRACT

A combination lawn/garden ornament and cremation container comprises a decorative water fountain adapted to circulate water from a water source upwardly and to allow the water to cascade downwardly and an openable and closable compartment adapted to contain cremated remains of a deceased. The fountain includes a water reservoir, a pump and plumbing. The plumbing has a first end connected to the pump and has a second end open to atmosphere and located above the reservoir. The pump is operable to pump water from the reservoir upwardly through the plumbing. The openable and closable compartment comprises a bowl for receiving the cremated remains therein, the bowl being removably securable to the fountain.

11 Claims, 1 Drawing Sheet

COMBINATION LAWN/GARDEN ORNAMENT AND CREMATION CONTAINER

FIELD OF THE INVENTION

This invention relates generally to funeral products, and more particularly to cremation containers for displaying cremated human remains contained therein.

BACKGROUND OF THE INVENTION

Cremation is a growing segment of the funeral industry. Consequently, there is an increasing demand for more and higher quality styles and designs of cremation containers.

One popular design theme for cremation urns is the outdoor/animal theme. Five such designs are disclosed in U.S. Pat. Nos. Des. 356,421, 370,767, 370,766 and 370,768, and U.S. Patent application Ser. No. 08/733,882, all of which are assigned to the assignee of the present invention and are hereby incorporated by reference herein as if fully set forth in their entirety.

Other, more traditional styles of cremation urns are disclosed in, for example, U.S. Pat. Nos. Des. 344,839, 345,848, 356,422 and 360,732, all of which are assigned to the assignee of the present invention and are hereby incorporated by reference herein as if fully set forth in their entirety.

All of the above-described cremation containers are adapted to be displayed in the residence of a loved one of the deceased, for example, on a fireplace mantel, coffee table, end table or the like.

There is a continuing need for attractive, yet somewhat non-traditional, progressive or alternative, means for displaying the cremated remains of a deceased by a loved one wishing to memorialize the past life of the deceased.

Accordingly, it is a main objective of the present invention to provide an alternative means of displaying the cremated remains of a deceased for memorial purposes by a loved one of the deceased which is in contrast to the more traditional types of cremation containers presently in display.

SUMMARY OF THE INVENTION

In accordance with the stated objective, the present invention is a combination lawn/garden ornament and cremation container. The combination lawn/garden ornament and cremation container comprises a decorative water fountain adapted to circulate water from a water source upwardly and to allow the water to cascade downwardly, and an openable and closable compartment adapted to contain cremated remains of a deceased.

The fountain preferably includes a water reservoir, a pump and plumbing. The plumbing has a first end connected to the pump and has a second end open to atmosphere and located above the reservoir. The pump is operable to pump water from the reservoir upwardly through the plumbing. The openable and closable compartment comprises a bowl for receiving the cremated remains therein, the bowl being removably securable to the fountain.

The fountain includes a basin containing the water reservoir. A structure extends upwardly from the basin. The second end of the plumbing is positioned such that water exiting therefrom cascades down the upwardly extending structure. The bowl is removably securable to a lower side of the basin. The plumbing extends upwardly along a rear, normally concealed from view surface of the upwardly extending structure and the second end extends through the upwardly extending structure to direct water exiting therefrom along a front, normally visible surface of the upwardly extending structure. The upwardly extending structure includes a region on the front, normally visible surface thereof for including a personalized inscription memorializing the deceased. The upwardly extending structure may further include decorative flowers or the like on the front, normally visible surface over which the water may cascade.

The main advantage of the present invention is that a combination lawn/garden ornament and cremation container is provided which provides a loved one of a deceased an alternative, somewhat nontraditional yet nonetheless attractive means of displaying the cremated remains of the deceased.

These and other objects and advantages of the present invention will become more readily apparent during the following detailed description taken in conjunction with the drawings herein, in which:

DETAILED DESCRIPTION OF THE INVENTION

Figure 2:
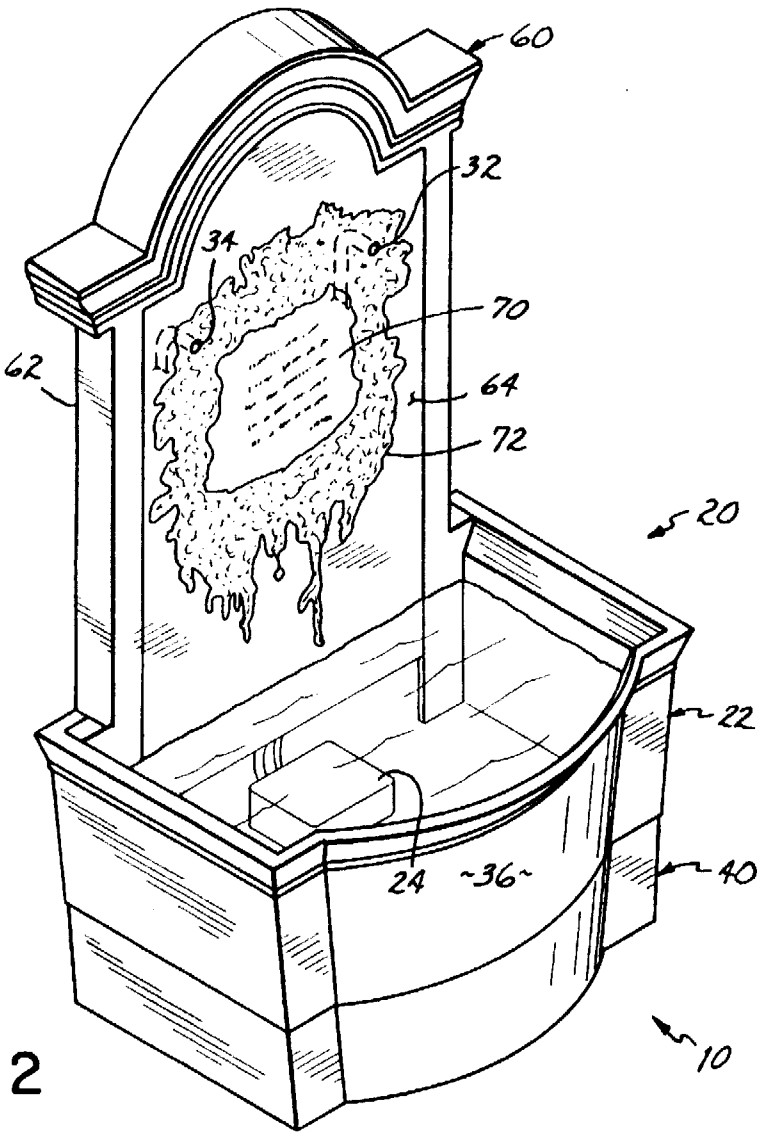
FIG. 2 is a perspective view of the combination lawn/garden ornament and cremation container of FIG. 1.
Figure 1:
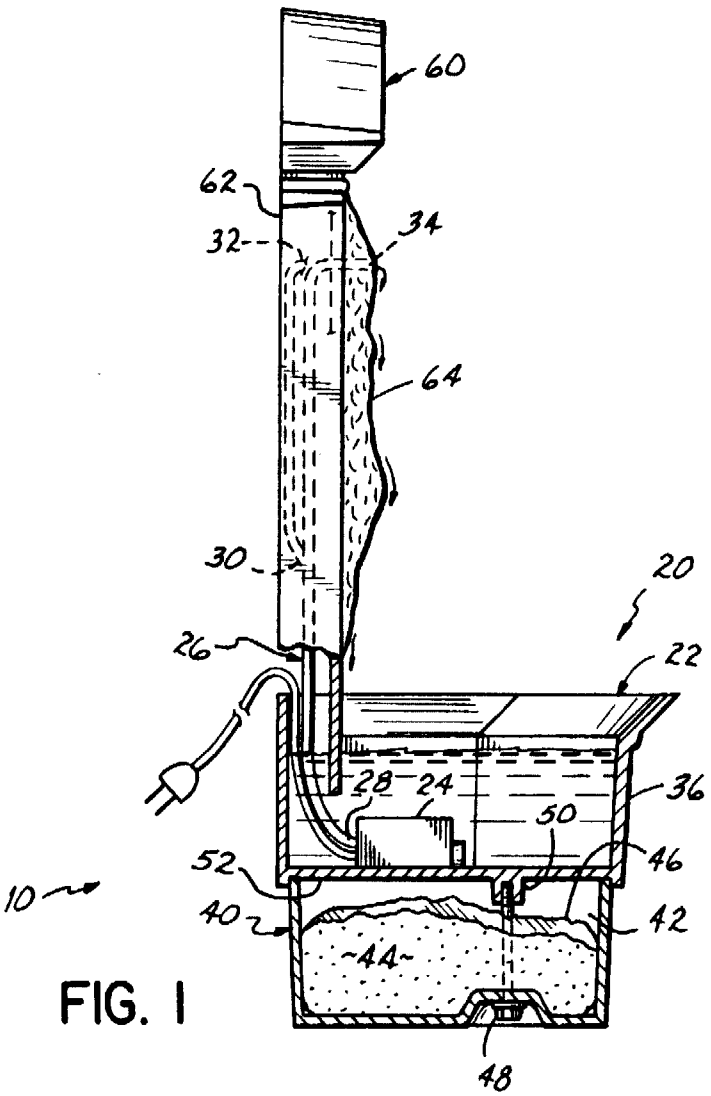
FIG. 1 is a side cross-sectional view of the combination lawn/garden ornament and cremation container of the present invention.

Referring first to FIGS. 1 and 2, there is illustrated a combination lawn/garden ornament and cremation container of the present invention, designated generally by the numeral 10. The combination lawn/garden ornament and cremation container 10 comprises, generally, a decorative water fountain 20 adapted to circulate water from a water source upwardly and to allow the water to cascade downwardly, and an openable and closeable compartment 40 adapted to contain cremated remains of a deceased.

The fountain 20 includes a water reservoir 22, a pump 24 and plumbing 26. Plumbing 26 includes a first end 28 connected to the pump 24 and a second end 30 which is subdivided into ends 32 and 34 which are open to atmosphere and which are located above the reservoir 22. The pump 24 is operable to pump water from the reservoir 22 upwardly through the plumbing 26. The openable and closeable compartment 40 comprises a bowl 42 for receiving cremated remains 44 therein which may be encased within a plastic bag 46 or the like. Bowl 42 is removably securable to a basin portion 36 of fountain 20 via a bolt 48 which threadably engages a tapped boss 50 projecting downwardly from a lower surface 52 of the basin 36. Silicone caulk or the like is used to seal the bowl 42 to the basin 36.

Ends 32 and 34 of the plumbing 26 have positions such that water exiting therefrom cascades down and upwardly extending structure 60 which extends upwardly from the basin 36 of the fountain 20. In particular, the plumbing 26 extends upwardly along a rear, normally concealed from view surface 62 of the upwardly extending structure 60. Ends 32 and 34 extend through the upwardly extending structure 60 to direct water exiting therefrom along a front, normally visible surface 64 of the upwardly extending structure 60. The upwardly extending structure 60 further includes a region 70 on the front, normally visible surface 64 thereof for including a personalized inscription memorializing the deceased. In addition, the upwardly extending structure 60 may further include on the front, normally visible surface 64 decorative flowers or the like 72 over which the water may cascade.

A suitable fountain 20 from which to fabricate the present invention is available from Virginia Metal Crafters, Waynesboro, Va., as part Nos. 9931or 6547.

Those skilled in the art will readily recognize numerous adaptations and modifications which can be made to the present invention which will result in an improved combination lawn/garden ornament and cremation container, yet all of which will fall within the spirit and scope of the present invention as defined in the following claims. Accordingly, the invention is to be limited only by the scope of the following claims and their equivalents.

What is claimed is:

1. A combination lawn/garden ornament and cremation container comprising:

a decorative water fountain adapted to circulate water from a water source upwardly said fountain including an upwardly extending decorative structure over which the water cascades downwardly;

said fountain including an openable and closable compartment adapted to contain cremated remains of a deceased.

2. A combination lawn/garden ornament and cremation container comprising:

a decorative water fountain adapted to circulate water from a water source upwardly and to allow the water to cascade downwardly;

said fountain including an openable and closable compartment adapted to contain cremated remains of a deceased;

said fountain including a water reservoir, a pump and plumbing, said plumbing having a first end connected to said pump and having a second end open to atmosphere and located above said reservoir, said pump being operable to pump water from said reservoir upwardly through said plumbing;

said openable and closable compartment comprising a bowl for receiving the cremated remains therein, said bowl being removably securable to said fountain.

3. The combination of claim 2 wherein said fountain includes a basin containing said water reservoir and a structure extending upwardly from said basin.

4. The combination of claim 3 wherein said second end of said plumbing is positioned such that water exiting therefrom cascades down said upwardly extending structure.

5. The combination of claim 4 wherein said bowl is removably securable to a lower side of said basin.

6. The combination of claim 5 wherein said plumbing extends upwardly along a rear, normally concealed from view surface of said upwardly extending structure and said second end extends through said upwardly extending structure to direct water exiting therefrom along a front, normally visible surface of said upwardly extending structure.

7. The combination of claim 6 wherein said upwardly extending structure includes a region on said front, normally visible surface for including a personalized inscription memorializing the deceased.

8. The combination of claim 7 wherein said upwardly extending structure includes on said front, normally visible surface decorative flowers over which the water may cascade.

9. A combination ornament and cremation container comprising:

a decorative water fountain adapted to circulate water from a water source upwardly and to allow the water to cascade downwardly;

said fountain including an openable and closable compartment comprising a bowl for receiving the cremated remains therein, said bowl being removably securable to said fountain.

10. A combination ornament and cremation container comprising:

a decorative fountain;

means for continuously circulating a liquid through said fountain;

said fountain including an upwardly extending decorative structure over which the liquid cascades downwardly, an openable and closable compartment connected to said fountain and adapted to contain cremated remains of a deceased.

11. A combination ornament and cremation container comprising:

a decorative fountain;

means for continuously circulating a liquid through said fountain; and means for containing cremated remains forming a part of said fountain.

* * * * *